US011577421B2

(12) United States Patent
Menzolini et al.

(10) Patent No.: US 11,577,421 B2
(45) Date of Patent: Feb. 14, 2023

(54) CUTTING APPARATUS AND METHOD

(71) Applicant: SACMI Cooperativa Meccanici Imola Societa' Cooperativa, Imola (IT)

(72) Inventors: Ruggero Menzolini, Imola (IT); Davide Penazzi, Imola (IT)

(73) Assignee: SACMI Cooperativa Meccanici Imola Societa' Cooperativa

( * ) Notice: Subject to any disclaimer, the term of this patent is extended or adjusted under 35 U.S.C. 154(b) by 0 days.

(21) Appl. No.: 17/291,704

(22) PCT Filed: Oct. 28, 2019

(86) PCT No.: PCT/IB2019/059226
§ 371 (c)(1),
(2) Date: May 6, 2021

(87) PCT Pub. No.: WO2020/095145
PCT Pub. Date: May 14, 2020

(65) Prior Publication Data

US 2022/0001567 A1 Jan. 6, 2022

(30) Foreign Application Priority Data

Nov. 7, 2018 (IT) ..... 102018000010118

(51) Int. Cl.
*B26F 1/18* (2006.01)

(52) U.S. Cl.
CPC ..... *B26F 1/18* (2013.01); *B26F 2210/04* (2013.01)

(58) Field of Classification Search
CPC ..... Y10S 83/946; Y10T 83/04; Y10T 83/033; B26F 1/18; B26F 1/20; B26F 2210/04; B26F 2210/00; B26D 1/01; B26D 1/02; B26D 3/08
USPC ..... 413/67; 425/809, 289–292, 294; 82/101, 82/46
See application file for complete search history.

(56) References Cited

U.S. PATENT DOCUMENTS

| | | | | |
|---|---|---|---|---|
| 7,673,543 | B2 * | 3/2010 | Albonetti | B26D 1/02 413/67 |
| 10,052,782 | B2 * | 8/2018 | Sain | B26D 1/02 |
| 10,703,002 | B2 * | 7/2020 | Bergami | B23Q 17/2442 |
| 2007/0089587 | A1 * | 4/2007 | Liao | B26F 1/18 83/879 |

FOREIGN PATENT DOCUMENTS

| | | | |
|---|---|---|---|
| CN | 102922549 | A | 2/2013 |
| EP | 3103603 | A1 | 12/2016 |
| WO | 2004004993 | A1 | 1/2004 |
| WO | 2011058500 | A1 | 5/2011 |

* cited by examiner

*Primary Examiner* — Phong H Nguyen
(74) *Attorney, Agent, or Firm* — Laubscher & Laubscher PC

(57) ABSTRACT

A cutting apparatus and method are disclosed to form the preferential fracture line of a capsule for closing containers, in which a rotating carousel carries a plurality of spindles, each of which can engage a respective capsule that is rolled against a contact surface made of ultra-high molecular weight polyethylene, and in which a fixed blade with a circular sector performs the cut on the rolling capsule, the cutting apparatus and method being applicable to capsules of different dimensions and types.

14 Claims, 5 Drawing Sheets

CUTTING APPARATUS AND METHOD

CROSS-REFERENCE TO RELATED APPLICATIONS

This application is a § 371 National Stage Entry of International Patent Application No. PCT/IB2019/059226 filed Oct. 28, 2019. Application No. PCT/M2019/059226 claims priority of Italian Patent Application IT-102018000010118 filed Nov. 7, 2018. The entire content of these applications is incorporated herein by reference.

BACKGROUND OF THE INVENTION

The invention relates to a cutting apparatus and method, in particular for cutting or incising products made of plastics and/or a metal material (for example aluminium and/or steel).

Specifically but not exclusively, the invention can be used to produce capsules made of plastics for closing containers, in particular for making the preferential weakening or fracture line, arranged between the closing portion of the capsule and the guarantee ring or band, for defining a safety device that is able to proof that the first opening of the capsule has taken place.

Making the preferential fracture line of a guarantee band of a capsule by a cutting apparatus including a rotating carousel that carries a plurality of spindles is known, each of which spindle is rotatable around its own axis, in which a spindle engages a respective capsule to be cut and, by a movement that includes a rotation around the axis thereof and a rotation around the axis of the carousel, rotates the capsule on an abutting element that carries a shaped blade according to the type of cut that it is desired to perform.

Patent publications WO 2004/004993 A1 and WO 2011/058500 A1 show examples of cutting apparatuses of the type mentioned above.

In cutting apparatuses of known type, in order to rotate the capsules with respect to the cutting tool, the latter is generally fitted to a circular sector provided with knurling that is couplable by meshing with complementary knurling provided on the side wall of the capsule.

Known apparatuses have however some limits and drawbacks.

In the first place, with the varying of the dimensions of the capsule and/or of the shape and/or of the pitch of the knurling, the knurled sector has to be replaced, with a resulting increase in the complication and cost of the machining.

Secondly, in the case of capsules having knurls with teeth spaced far apart from one another, there is a risk that the meshing between the knurling of the circular sector and that of the capsule is irregular or imprecise, in particular with possible complications in the critical step of transition between a tooth of one knurl and another, with a consequent risk of an imprecise and uneven cut being made.

Further, in the case of capsules devoid of knurling, the knurling of the circular sector is not able to engage the capsules effectively. In these cases in general a knurled blade is used that in addition to forming the weakening line between the closing portion of the capsule and the guarantee band should ensure correct rolling of the capsule. This nevertheless involves significant structural complication and high risks of malfunction.

SUMMARY OF THE INVENTION

One object of the invention is to provide a cutting apparatus and/or method that is able to remedy one or more of the aforesaid drawbacks of the prior art.

One advantage is to enable cutting machining with varying of the dimensions of the capsule and/or of the shape and/or of the pitch of the knurling on the capsule, without the need to replace components of the cutting apparatus.

One advantage is to ensure a correct cut also in the case of closing capsules provided with knurls with teeth spaced far apart from one another and/or in the case of closing capsules devoid of lateral knurling.

One advantage is to make a cutting apparatus and method of great versatility, which are applicable to capsules of various dimensions and types.

One advantage is to make available a cutting apparatus that is constructionally simple and cheap to make.

One advantage is to provide a cutting apparatus with relatively high mechanical resistance, in particular to wear and fracture.

These objects and still others are achieved by an apparatus and/or by a method according to one or more of the claims set out below.

In one embodiment, the cutting apparatus includes an abutting element, in particular in the shape of a circular sector, including a contact surface which is intended for contact with the capsules and which is made of plastics with a friction coefficient suitable for ensuring rolling of the capsules by friction, for example a dynamic friction coefficient included between 0.15 and 0.30. The plastics of the contact surface on which rolling by friction occurs may include ultra-high molecular weight polyethylene UHMWPE.

In one embodiment, a cutting apparatus, suitable for forming a preferential fracture line in a capsule for closing containers, includes at least one rotating spindle that can be engaged with a respective capsule that is rolled against a contact surface of an abutting element made of a material that includes ultra-high molecular weight polyethylene, a fixed blade being arranged for performing cutting on the rolling capsule. The contact surface could be arranged on the spindle, in addition to or instead of the contact surface on the abutting element.

In one embodiment, a cutting method includes the step of rolling a capsule for closing containers against a contact surface made of plastics, in particular of ultra-high molecular weight polyethylene, whilst a fixed blade forms a preferential fracture line on the rolling capsule.

BRIEF DESCRIPTION OF THE DRAWINGS

The invention can be better understood and implemented with reference to the attached drawings that illustrate some embodiments thereof by way of non-limiting example, in which.

DETAILED DESCRIPTION

Figure 1:
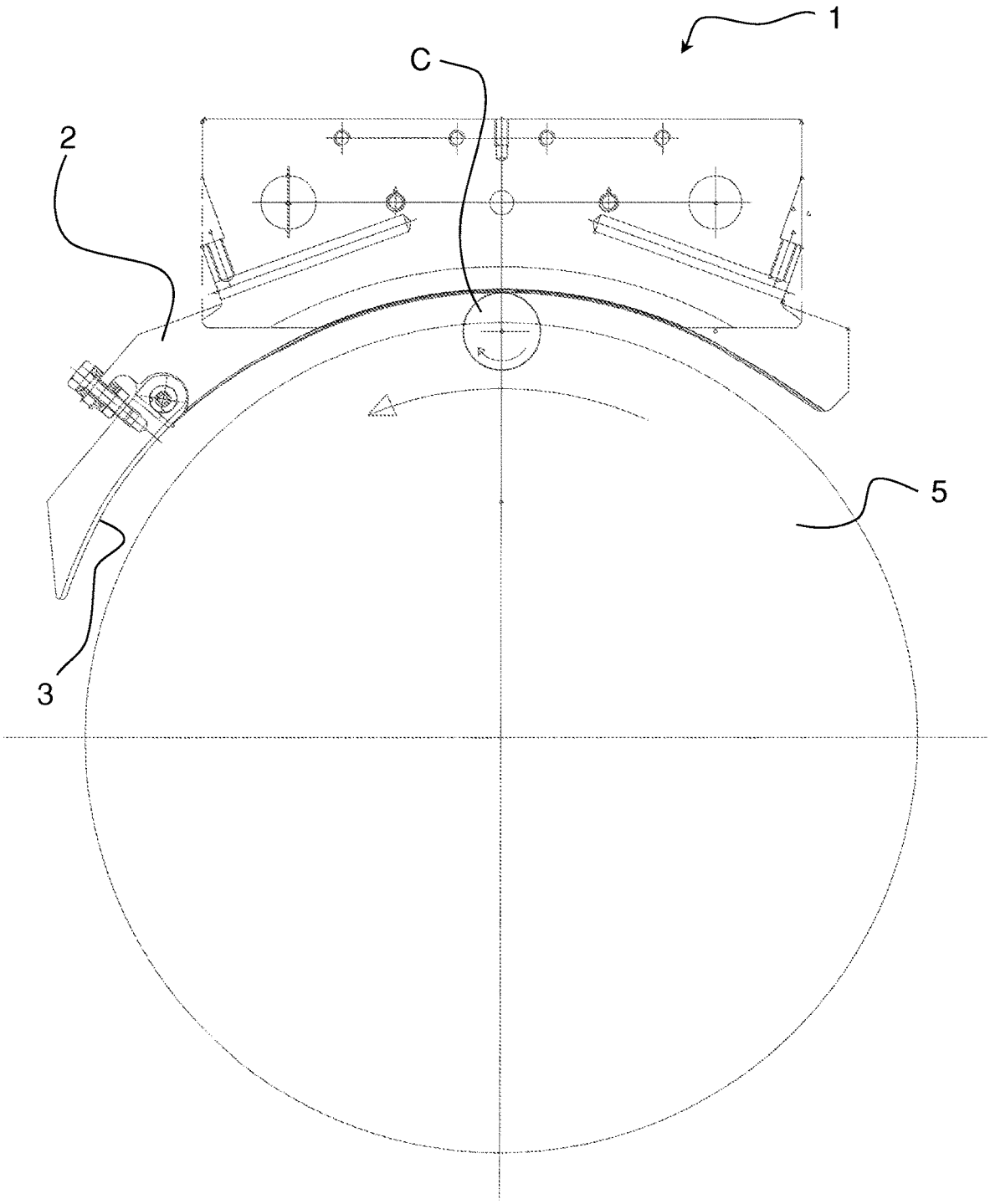
FIG. 1 is a top plan view of an embodiment of a cutting apparatus made in accordance with the present invention.
Figure 2:
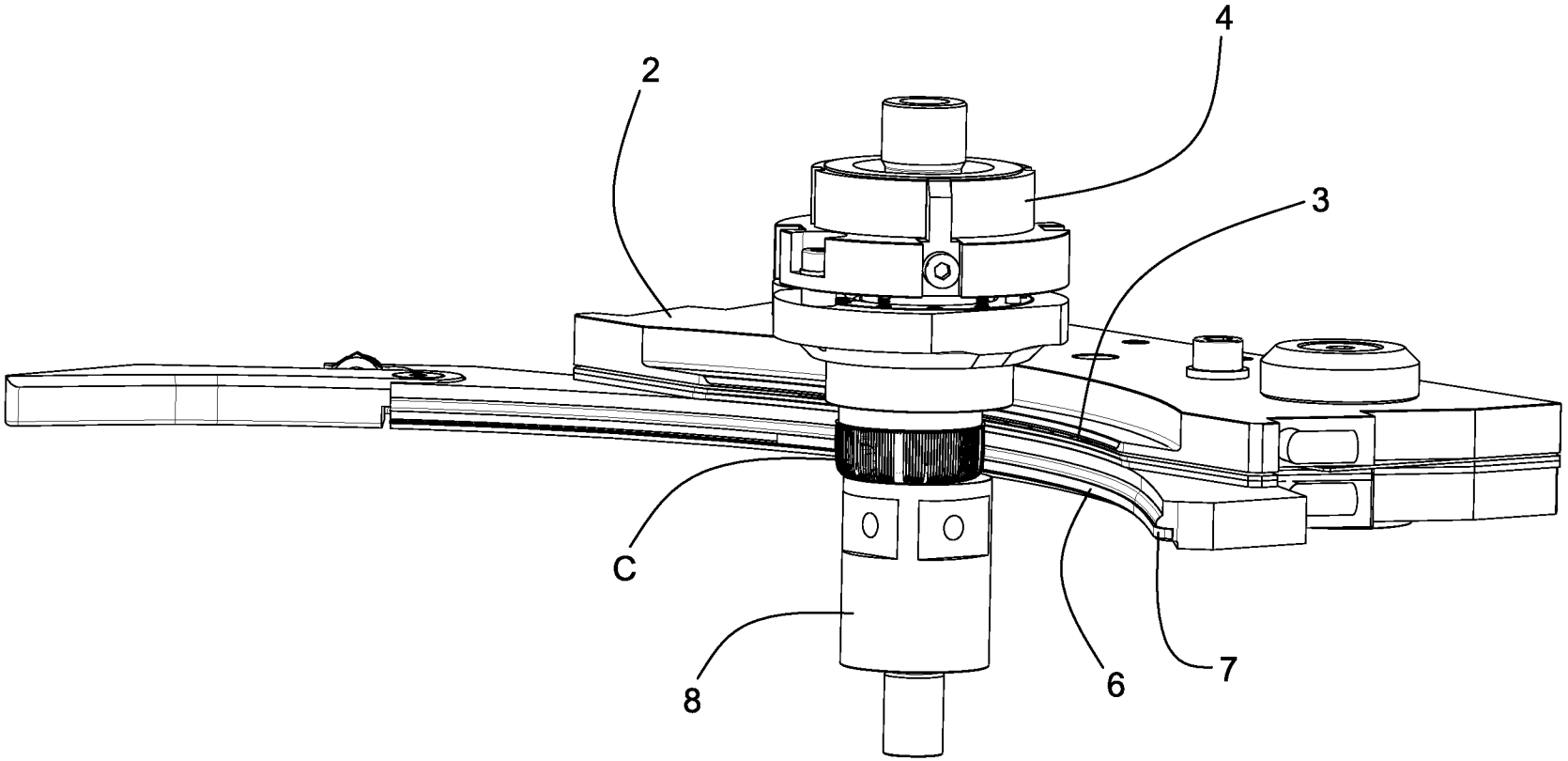
FIG. 2 is a perspective view of a portion of the apparatus of FIG. 1.
Figure 3:
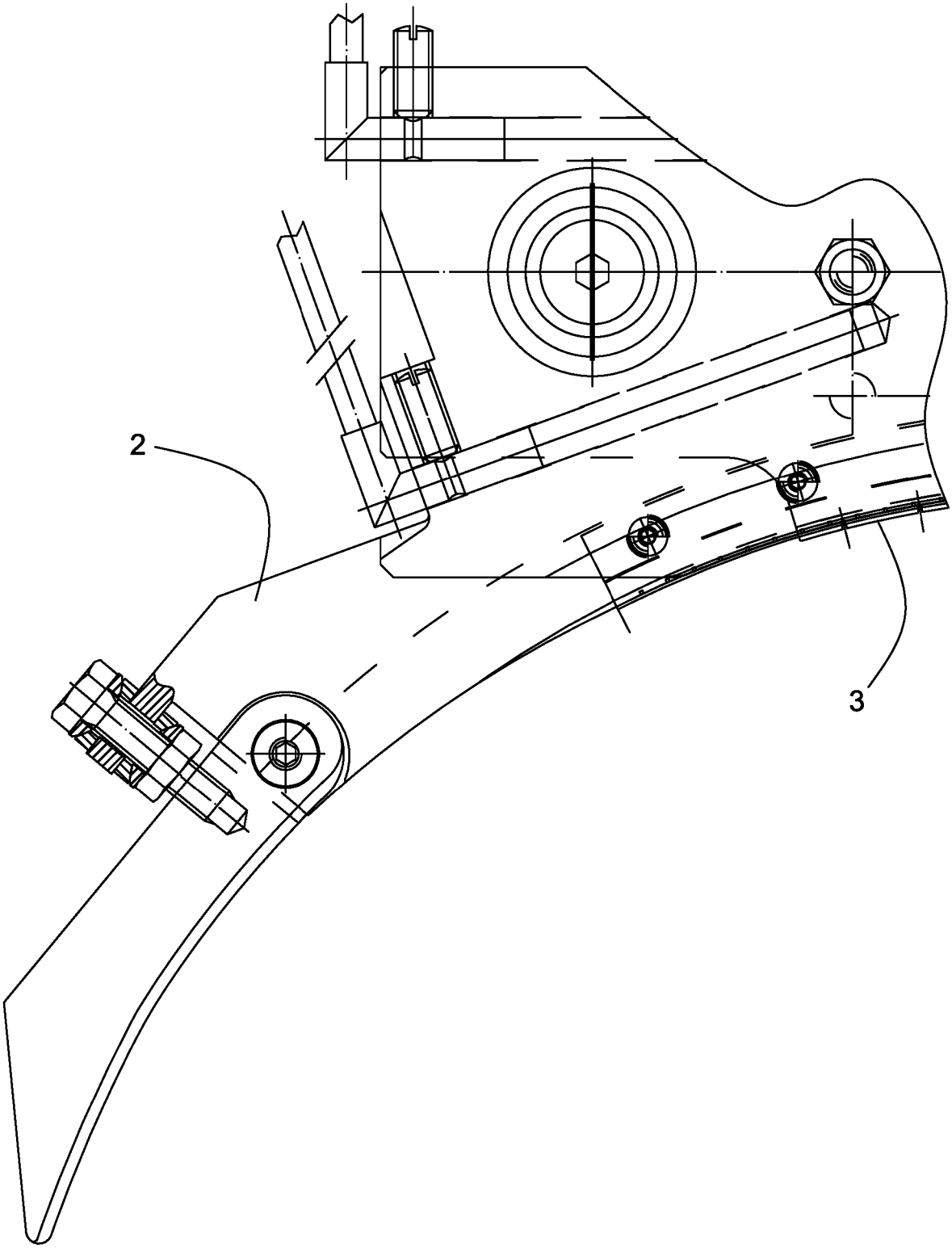
FIG. 3 is a top plan view of a portion of the apparatus of FIG. 1.
Figure 4:
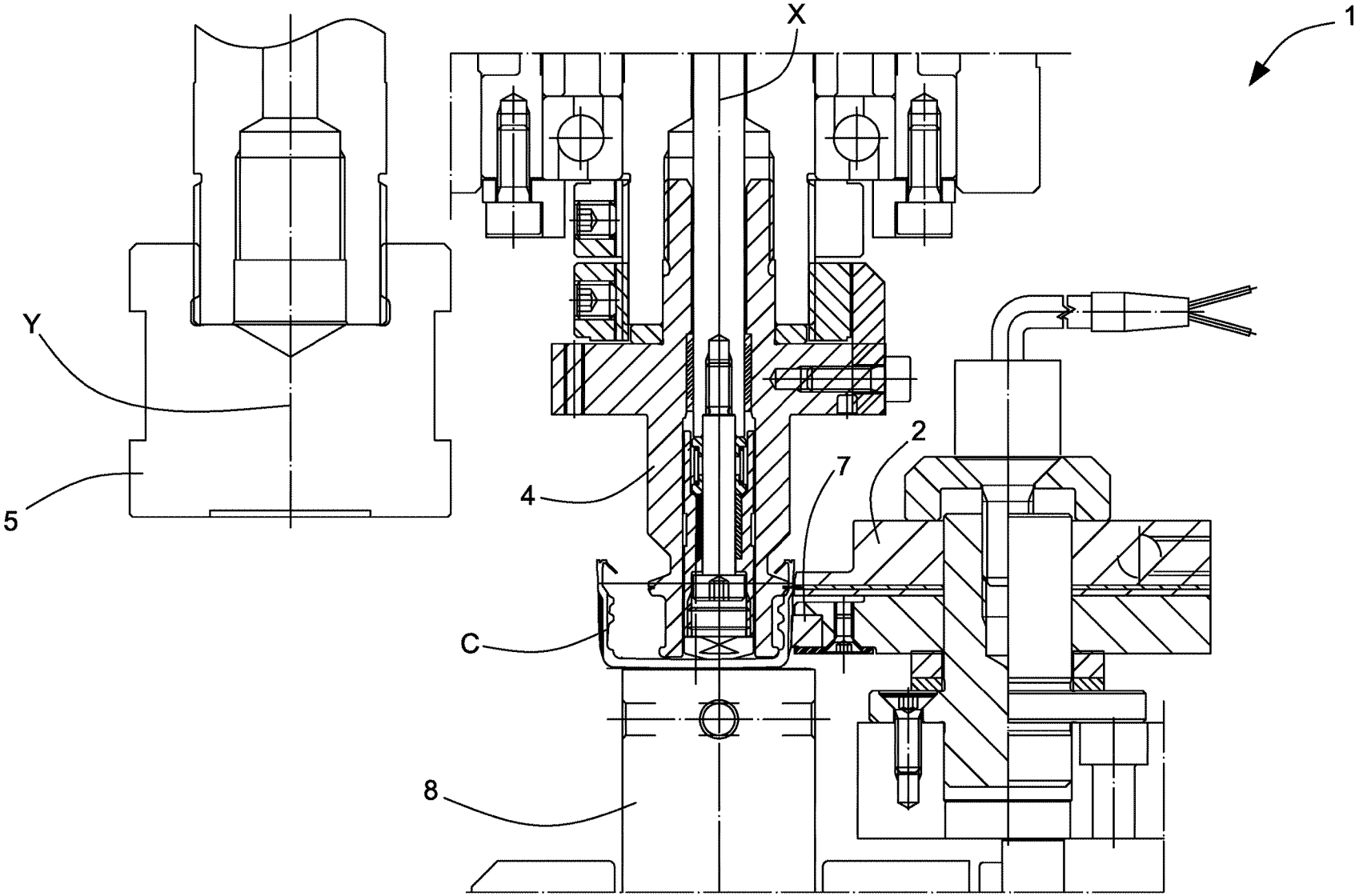
FIG. 4 is a section, according to a vertical plane, of a portion of the apparatus of FIG. 1.
Figure 5:
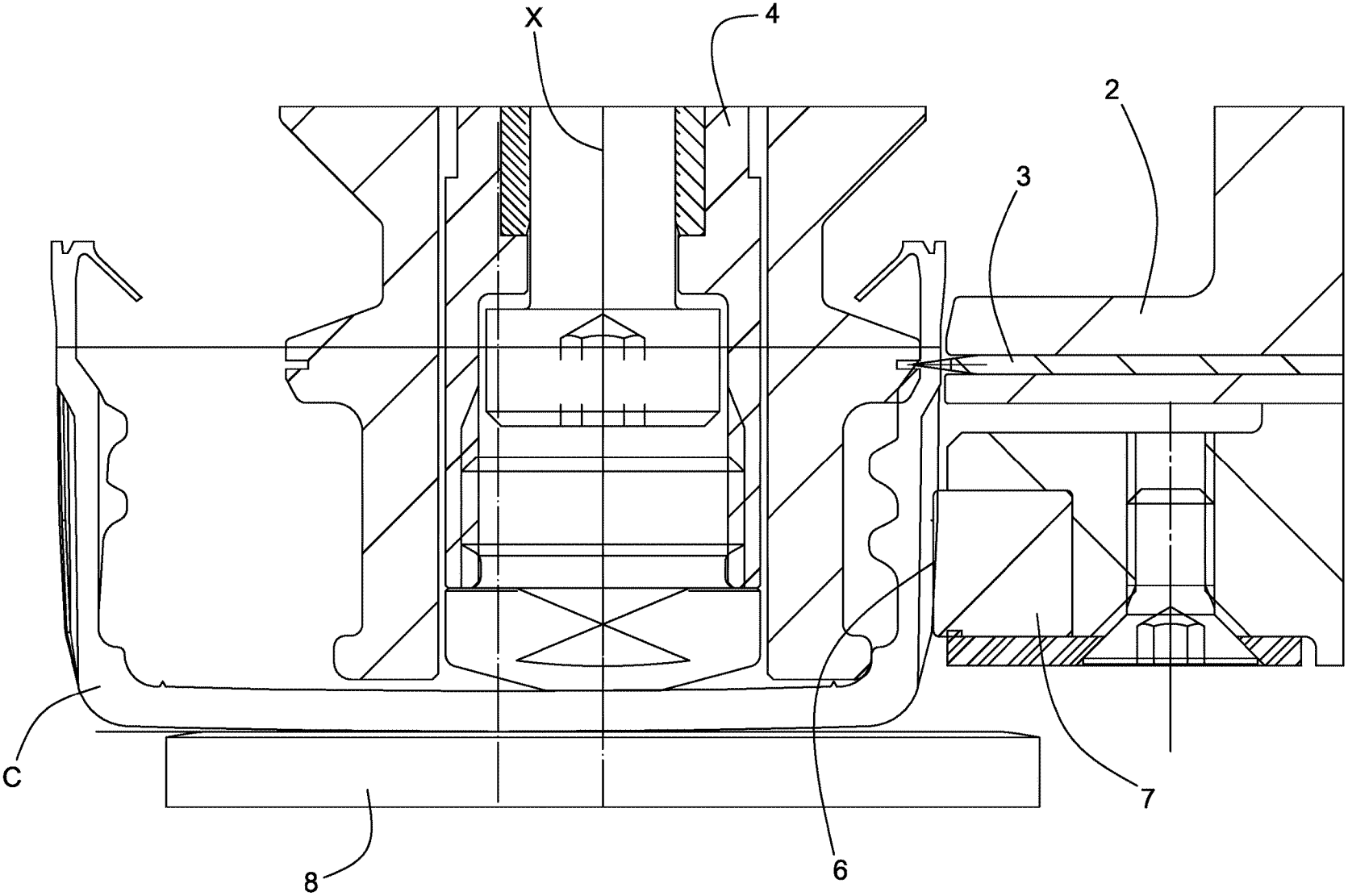
FIG. 5 shows an enlarged detail of FIG. 4.

With reference to the aforementioned figures, with 1 a cutting apparatus has been indicated overall that is usable in a plant for producing capsules (in particular made of plastics) for closing containers, in particular for making the preferential weakening or fracture line, arranged between the closing portion of a capsule and the guarantee ring or band, to give rise to a security device that is able to bear witness to the first opening of the capsule.

The cutting apparatus 1 may include, in particular, at least one abutting element 2 including at least one abutting surface configured in such a manner that a capsule C for closing containers can roll against the abutting surface along a rolling path. The abutting surface and the corresponding rolling path may have, as in this specific embodiment, a longitudinal extent substantially in the shape of a circular sector.

The cutting apparatus 1 may include, in particular, at least one blade 3 arranged on the abutting element 2 to perform a cut on a capsule C that rolls against the abutting surface to form a preferential line of fracture between a closing portion of the capsule C and a guarantee band of the capsule C. The blade 3 may have, as in this specific embodiment, a longitudinal extent in the shape of a circular sector. The blade 3 may include, in particular, any blade, also of known type, suitable for cutting the preferential line of fracture of a security device of a capsule for closing containers.

The cutting apparatus 1 may include, in particular, at least one spindle 4 that is rotatable around its own rotation axis X. The cutting apparatus 1 may include, in particular, at least one carousel 5 rotating around a (vertical) rotation axis Y. The carousel 5 may carry a plurality of spindles 4 arranged spaced apart from one another angularly. Each spindle 4 is movable along a circular trajectory around the rotation axis Y of the carousel 5 that carries the spindles 4.

Each spindle 4 may be configured, in particular, to engage with at least one inner surface of a capsule C for containers. Each spindle 4 is rotated around its own rotation axis X, for example by drive elements controlled by (electronic and programmable) control elements that control the operation of the cutting apparatus 1.

Each spindle 4 is movable along the rolling path, i.e. along a path parallel to the abutting surface so as to cause rolling of a respective capsule C when the capsule C is engaged, with a certain dragging force, between the spindle 4 and the abutting surface, in order for the cut to be performed on the capsule C to form the preferential fracture line.

The cutting apparatus 1 may include, in particular, at least one contact surface 6 made of plastics, which can be arranged on the abutting element 2 (in particular on the abutting surface, as in the illustrated embodiment) and/or on a side wall of the spindle 4 (in embodiments that are not illustrated), in such a manner that the contact surface 6 is engageable in contact with a side wall of the capsule to cause the rolling by friction thereof.

In the specific embodiment, the contact surface 6 made of plastics substantially constitutes the abutting surface of the abutting element 2, even if, as said, it is possible, in other embodiments that are not illustrated, that the contact surface made of plastics is arranged on an (outer) side wall of the spindle 4.

The contact surface 6 may include or consist of at least one revolution surface sector (for example a cylindrical and/or conical surface) obtained by rotating a generating line around a rotation axis. The generating line may include, for example, a rectilinear segment (tilted or parallel to the rotation axis), or a curved segment, or a broken line, or a mixed curvilinear and rectilinear composite line, or a shaped line, etc. The contact surface 6 may be formed in its entirety, or at least largely or predominantly (more than 50%), by at least one revolution surface sector.

The revolution surface may further include, in embodiments that are not illustrated, a surface extending longitudinally in a rectilinear or substantially rectilinear direction, which surface may be considered, from a theoretical geometric point of view, as in the particular case of a revolution surface obtained by rotating a generating line around a rotation axis placed at an infinite distance.

In the illustrated embodiment, the contact surface 6 in the form of a revolution surface sector is arranged on the abutting element 2. The contact surface 6 may extend, in particular, continuously along the rolling path or at least most of the rolling path.

In the illustrated embodiment the revolution surface is obtained by rotating a line around the rotation axis Y of the carousel 5 that rotates the spindles 4. In other embodiments, which are not illustrated, the contact surface 6 could be arranged on each spindle 4 and the revolution surface (for example cylindrical) could be obtained by rotating a line around the rotation axis X of the respective spindle 4.

The contact surface 6 may be arranged, in particular, on an insert 7 arranged inside a recess of the abutting element 2. The insert 7 may be fixed removably to the abutting element 2 (for example by screw connection elements as in this specific case).

The carousel 5 may include, in particular, a support element 8 to enable the capsules C to be supported whilst the spindles 4 engage the capsules C and roll the capsules C against the abutting element 2 and the blade 3.

The cutting apparatus 1 may include, in particular, according to one embodiment that is not illustrated, at least one further contact surface made of plastics arranged on the abutting surface and/or on a side wall of the spindle.

The further contact surface made of plastics may be arranged, in particular, in such a manner as to be engageable in contact with a side wall of the capsule to supply a further friction surface to promote, in collaboration with the contact surface, rolling of the capsule by friction.

The further contact surface may, in particular, extend in a manner substantially parallel to the contact surface. The further contact surface may be, in particular, spaced apart from the contact surface (in particular spaced in a vertical direction).

The contact surface 6 and/or the further contact surface may be made, in particular, of plastics that include ultra-high molecular weight polyethylene (UHMWPE). It is known that ultra-high molecular weight polyethylene UHMWPE has relatively high resistance to abrasion and relatively high impact strength. It has been moreover found that UHMWPE is particularly suitable for forming a contact surface (such as for example the contact surface 6 and/or the further contact surface) that permits correct and effective rolling of the capsule (especially a capsule made of plastics, for example made of HDPE or of copolymer PP) during the cutting step for the formation of the preferential fracture line and, at the same time, permits appropriate processing of a high number of capsules, i.e. with a high working life of the surface. In particular, it is considered that the properties that make the UHMWPE a material that is particularly suitable for making the contact surface that permits correct rolling by friction of the capsule, could be the appropriate values of the dynamic friction coefficient and/or of the resistance to wear and/or hardness.

The plastics of the contact surface 6 and/or of the further contact surface may include UHMWPE with the addition of additives (in particular additives that are suitable for improving the resistance to wear and/or slowing degradation and/or reduce the speed of oxidation of the material). The plastics of the contact surface 6 and/or of the further contact surface may include, in particular, materials of the family of UHMWPE products that is known commercially as TIVAR®, more specifically (by way of example) the product TIVAR® H. OR. T.

The contact surface 6 may be processed, in particular, so as to have surface roughness Ra=6.3±3.0 μm (micrometres), or Ra>1.6 μm and/or Ra<12.5 μm, or the surface roughness Ra may be >0.8 μm, or >1.8 μm, or >2.8 μm, or >3.8 μm, or >4.8 μm. The surface roughness Ra may be <13.8 μm, or <12.8 μm, or <11.8 μm, or <10.8 μm.

The contact surface 6 may be made, in particular, of plastics with Shore hardness included between 48 and 68, or included between 50 and 66, or included between 52 and 64, or included between 54 and 62, or included between 56 and 60. The contact surface may be made, in particular, of plastics with a Shore hardness equal to 58±5.

In the present description, the indicated Shore hardness values may be, in particular, values that are obtainable with measurements conducted with tests performed in accordance with standard ISO 868, performed in an environment at 23° C., using testpieces measuring 10 mm in thickness (in particular removed from slabs that are 20-30 mm thick).

The contact surface 6 and/or the further contact surface may be made, in particular, of plastics with a dynamic friction coefficient of less than 0.50, or less than 0.45, or less than 0.40, or less than 0.35, measured by a tribo-system test on a pin made of plastics on a rotating steel disc. The contact surface 6 and/or the further contact surface may be made, in particular, of plastics with a dynamic friction coefficient that is greater than 0.10, or greater than 0.15, or greater than 0.20, or greater than 0.25, measured also in this case by a tribo-system test on a pin made of plastics on a rotating steel disc.

The contact surface 6 and/or the further contact surface may be made, in particular, of plastics with a resistance to wear less than 20 μm/km, or less than 15 μm/km, or less than 10 μm/km, measured by a tribo-system test on a pin made of plastics on a rotating steel disc.

In the specific embodiment, the contact surface 6 and/or the further contact surface may be made of plastics with a dynamic friction coefficient included between 0.15 and 0.30 and with a resistance to wear equal to about 6 μm/km, measured by a tribo-system test on a pin made of plastics on a rotating steel disc.

In the present description, it is understood that the indicated values relating to the dynamic friction coefficient and to resistance to wear are values that are obtainable from measurements conducted with tests performed on a pin made of plastics on a rotating steel disc (tribo-system), with the following test conditions: pressure: 3 MPa; sliding speed: 0.33 m/sec; surface roughness of the coupling surface made of C35 steel: Ra=0.70-0.90 μm; total distance travelled: 28 km; normal environment (air 23° C., relative humidity 50%), non-lubricated operation.

The contact surface 6 and/or the further contact surface may be made, in particular, of plastics with an elastic modulus greater than 600 MPa, or greater than 650 MPa. The contact surface 6 and/or the further contact surface may be made, in particular, of plastics with un elastic modulus less than 800 MPa, or less than 750 MPa. The contact surface 6 and/or the further contact surface may be made, in particular, of plastics with an elastic modulus equal to 700±25 MPa.

In the present description, the indicated elastic modulus values may be, in particular, values obtainable from measurements conducted with tests performed in accordance with standard ISO 527-1/-2 with speeds equal to 1 mm/min.

The operation of the aforesaid cutting apparatus 1 implements a cutting method that includes the step of engaging at least one capsule C for closing containers between the rotatable spindle 4 and the abutting surface of the abutting element 2.

The cutting method may include, in particular, the step of moving the spindle 4 along the abutting surface and simultaneously rotating the spindle 4 on itself so as to cause the capsule C to roll on the abutting surface of the abutting element 2.

The cutting method may include, in particular, the step of performing, during rolling of the capsule C, a cut on the capsule C by the fixed blade 3 to form the preferential line of fracture between the closing portion of the capsule C and the guarantee band of the capsule C.

Rolling of the capsule C may occur, in particular, by friction at least against at least the contact surface 6 made of plastics arranged on the abutting surface of the abutting element 2 and/or on a side wall of the spindle 4. Rolling of the capsule C could further occur by friction against at least the further contact surface made of plastics arranged on the abutting surface of abutting element 2 and/or on a side wall of the spindle 4.

Owing to the contact surface 6 and/or the further contact surface, the cutting machining of the capsule C, which is suitable for forming the preferential line of fracture, can be performed on varying dimensions of the capsule C and/or of the shape of the possible knurling on the capsule C and/or of the pitch of the possible knurling on the capsule C, without the need to replace any component of the cutting apparatus 1, as the coupling that permits rolling does not occur through meshing of teeth of knurling, but through friction between a wall of the capsule C (provided with or devoid of knurling) and a contact surface that is suitable for any type of capsule C.

It is thus possible to ensure a correct cut also in the case of closing capsules C provided with knurls with teeth spaced far apart from one another and/or in the case of closing capsules C completely devoid of lateral knurling.

The invention claimed is:

1. Cutting apparatus including:

at least one abutting element conformed and arranged so that a capsule for closing containers can roll against said abutting element along a rolling path;

at least one blade arranged on said abutting element to make a cut on a capsule which rolls against said abutting element to form a preferential fracture line between a closure portion of the capsule and a guarantee band of the capsule;

at least one spindle rotatable about its rotation axis, said spindle being configured to engage with at least one inner surface of a capsule, said spindle being movable along said abutting element so as to cause the capsule to roll when the capsule is engaged between said spindle and said abutting element, so that the cut is performed on the capsule to form the preferential fracture line; and an insert arranged inside a recess of said abutting element, said insert including at least one contact surface made of plastics and engageable in contact with a side wall of the capsule, said contact surface being conformed as a smooth revolution surface geometrically obtained by rotating a line around a rotation axis, said at least one contact surface having a surface roughness Ra>0.8 μm and Ra<13.8 μm and a Shore hardness between 48 and 68.

2. Apparatus according to claim 1, wherein said insert is removably fixed to said abutting element.

3. Apparatus according to claim 1, wherein said contact surface is arranged on said abutting element and extends continuously along said rolling path, said cutting apparatus including at least one carousel which rotates said spindle about a rotation axis.

4. Apparatus according to claim 1, wherein said plastics include ultra-high molecular weight polyethylene (UHMWPE).

5. Apparatus according to claim 1, wherein said at least one contact surface is made of plastics with:

a dynamic friction coefficient less than 0.50; and/or a dynamic friction coefficient greater than 0.10; and/or a wear resistance of less than 20 μm/km, measured by a tribo-system test on a pin made of plastics on a rotating steel disk; and/or an elastic modulus greater than 600 MPa; and/or an elastic modulus less than 800 Mpa.

6. Apparatus according to claim 1, including at least one further contact surface made of plastics arranged on said abutting element and/or on a side wall of said spindle and arranged so that said at least one further contact surface is engageable in contact with a side wall of the capsule.

7. Apparatus according to claim 6, wherein said at least one further contact surface extends substantially parallel to said at least one contact surface and is spaced from the latter.

8. Cutting method including the steps of:

engaging a capsule for closing containers between a rotating spindle and an abutting element;

moving the spindle along the abutting element and simultaneously rotating the spindle on itself so as to cause the capsule to roll on the abutting element along a rolling path;

during rolling, making a cut on the capsule by means of a fixed blade to form a preferential fracture line between a closing portion of the capsule and a guarantee band of the capsule;

wherein said rolling occurs by friction against at least one contact surface made of plastics arranged on said abutting element and/or on a side wall of said spindle, wherein said contact surface is conformed as a smooth revolution surface geometrically obtained by rotating a line around a rotation axis, and wherein said contact surface is on an insert that is arranged inside a recess of said abutting element, said at least one contact surface having a surface roughness Ra>0.8 μm and Ra<13.8 μm and a Shore hardness between 48 and 6.

9. Method according to claim 8, wherein said contact surface is on insert is removably fixed to said abutting element.

10. Method according to claim 8, wherein said contact surface is arranged on said abutting element and extends continuously along said rolling path, said spindle being rotated by a carousel around a rotation axis.

11. Method according to claim 8, wherein said at least one contact surface is made of plastics including ultra-high molecular weight polyethylene (UHMWPE).

12. Method according to claim 8, wherein said at least one contact surface is made of plastics with a wear resistance of less than 20 μm/km, measured with a tribo-system test on a pin made of plastics on a rotating steel disk.

13. Method according to claim 8, wherein said at least one contact surface is made of plastics with a dynamic friction coefficient less than 0.50 and greater than 0.10.

14. Method according to claim 8, wherein said at least one contact surface is made of plastics with an elastic modulus greater than 600 Mpa and less than 800 Mpa.

* * * * *